US010460692B2

(12) United States Patent
Zhao

(10) Patent No.: US 10,460,692 B2
(45) Date of Patent: Oct. 29, 2019

(54) DISPLAY PANEL AND PRE-CHARGE SWITCHING METHOD FOR PIXEL UNITS THEREOF

(71) Applicants: HKC Corporation Ltd., Shenzhen, Guangdong (CN); Chongqing HKC Optoelectronics Technology Co., Limited, Chongqing (CN)

(72) Inventor: Wenqin Zhao, Chongqing (CN)

(73) Assignees: HKC CORPORATION LIMITED, Shenzhen, Guangdong (CN); CHONGQING HKC OPTOELECTRONICS TECHNOLOGY CO., LTD., Chongdong (CN)

( * ) Notice: Subject to any disclaimer, the term of this patent is extended or adjusted under 35 U.S.C. 154(b) by 131 days.

(21) Appl. No.: 15/580,312

(22) PCT Filed: Sep. 18, 2017

(86) PCT No.: PCT/CN2017/102020
§ 371 (c)(1),
(2) Date: Dec. 7, 2017

(87) PCT Pub. No.: WO2019/037172
PCT Pub. Date: Feb. 28, 2019

(65) Prior Publication Data

US 2019/0066623 A1 Feb. 28, 2019

(30) Foreign Application Priority Data

Aug. 25, 2017 (CN) ..... 2017 1 0743038

(51) Int. Cl.
*G09G 3/36* (2006.01)

(52) U.S. Cl.
CPC ..... *G09G 3/3696* (2013.01); *G09G 3/3677* (2013.01); *G09G 3/3611* (2013.01);
(Continued)

(58) Field of Classification Search
CPC ..... G09G 3/3696; G09G 3/3677; G09G 2310/027
See application file for complete search history.

(56) References Cited

U.S. PATENT DOCUMENTS 7,751,639 B1 * 7/2010 Finlayson ..... G06K 9/4647 345/690
2006/0291298 A1 12/2006 Kang et al.

FOREIGN PATENT DOCUMENTS

CN 1664908 A 9/2005
CN 1924649 A 3/2007
(Continued)

OTHER PUBLICATIONS

International Search Report dated May 22, 2018, in the corresponding PCT application PCT/CN2017/102020, 11 pages in Chinese.

*Primary Examiner* — Charles V Hicks
(74) *Attorney, Agent, or Firm* — Juan Carlos A. Marquez; Marquez IP Law Office, PLLC

(57) ABSTRACT

This application relates to a display panel and a pre-charge switching method for pixel units thereof. A timing controller of the display panel stores a gray-scale threshold. The timing controller calculates a gray-scale eigenvalue by using a first gray-scale parameter corresponding to pixel units in a first row and a second gray-scale parameter corresponding to pixel units in a second row, and pulls up a potential of a pre-charge signal when determining that the gray-scale eigenvalue satisfies a condition of the gray-scale threshold. A gate drive unit provides a scanning signal to a gate line in a second row within a period of providing a scanning signal
(Continued)

to a gate line in a first row when the pre-charge signal is at a high potential.

20 Claims, 10 Drawing Sheets

(52) U.S. Cl.
CPC ..... *G09G 2310/027* (2013.01); *G09G 2310/0251* (2013.01); *G09G 2310/08* (2013.01); *G09G 2360/16* (2013.01)

(56) References Cited

FOREIGN PATENT DOCUMENTS

| | | | |
|---|---|---|---|
| CN | 102103836 | A | 6/2011 |
| CN | 103517054 | A | 1/2014 |

* cited by examiner

| | D1 | D2 | D3 | D4 | D5 | D6 | D7 | D8 | D9 | D10 | D11 | D12 |
|---|---|---|---|---|---|---|---|---|---|---|---|---|
| P1 | 206 | 202 | 200 | 188 | 244 | 211 | 213 | 244 | 232 | 253 | 168 | 255 |
| P2 | 38 | 20 | 12 | 20 | 13 | 50 | 10 | 33 | 21 | 22 | 21 | 16 |

FIG. 2c

| | D1 | D2 | D3 | D4 | D5 | D6 | D7 | D8 | D9 | D10 | D11 | D12 |
|---|---|---|---|---|---|---|---|---|---|---|---|---|
| P1 | 206 | 202 | 200 | 188 | 244 | 211 | 213 | 244 | 232 | 253 | 168 | 255 |
| P2 | 202 | 198 | 196 | 184 | 240 | 207 | 209 | 240 | 228 | 249 | 164 | 251 |

FIG. 2d

| | D1 | D2 | D3 | D4 | D5 | D6 | D7 | D8 | D9 | D10 | D11 | D12 |
|---|---|---|---|---|---|---|---|---|---|---|---|---|
| P1 | 211 | 22 | 213 | 244 | 21 | 16 | 198 | 196 | 184 | 50 | 10 | 33 |
| P2 | 198 | 206 | 196 | 240 | 79 | 200 | 184 | 240 | 207 | 244 | 232 | 253 |

FIG. 2e

DISPLAY PANEL AND PRE-CHARGE SWITCHING METHOD FOR PIXEL UNITS THEREOF

BACKGROUND

Technical Field

This application relates to a drive technology of display panels, and in particular, to a display panel and a pre-charge switching method for pixel units thereof.

Related Art

A display drive manner includes: a system board transmits a color (such as R/G/B) compressed signal, a control signal, and a power source to a control board. After being processed by a timing controller (TCON), the signals are transmitted to a source driver and a gate driver. Necessary data and the power source are transmitted to a display area by using a relevant integrated circuit or chip, so that a display obtains a power source and signals required for picture presentation.

To enable a display panel to keep stable picture display, some designers design a pre-charge line (OEPSN) between a timing controller and a gate driver, and a potential of a pre-charge signal is managed and controlled by the timing controller. When the pre-charge line is at a high potential (H), the gate driver enables two rows of gate lines within a scanning period, so as to pre-charge pixel units in a $(n+1)^{th}$ row according to the design within a period of charging pixel units in an $n^{th}$ row When the pre-charge line is at a low potential (L), the gate driver enables only a gate line corresponding to a current scanning period.

However, in an existing display system, usually, a pre-charge line is normally kept at a high potential (H) or normally kept at a low potential (L). if the pre-charge line is normally kept at a low potential (L), the display panel does not perform pre-charging, that is, power consumption cannot be reduced by means of pre-charging. If the pre-charge line is normally kept at a high potential (H), a pre-charge time may be excessively long because of an excessively large difference between gray-scale values of pixel units in two adjacent rows. As a result, power consumption increases, and power consumption cannot be reduced by means of pre-charging.

SUMMARY

To resolve the foregoing technical problem, an objective of this application is to provide a display panel and a pre-charge switching method for pixel units thereof, so as to switch, by using gray-scale parameters of pixel units in each two adjacent rows, a pre-charge mode of pixel units in a next row.

The objective of this application is achieved and the technical problem of this application is resolved by using the following technical solutions. A display panel is provided according to this application. The display panel comprises: a substrate, comprising a display area and a wiring area around the display area, where a plurality of active switches, a plurality of gate lines, and a plurality of source lines are disposed in the display area, and a pixel unit is disposed at an intersection of each gate line and each source line; a source drive unit, connected to the plurality of source lines; a gate drive unit, connected to the plurality of gate lines; a timing controller, connected to the source drive unit and the gate drive unit; and a pre-charge line, connected between the timing controller and the gate drive unit, where the pre-charge line transmits a pre-charge signal output by the timing controller; and the timing controller calculates a gray-scale eigenvalue by using a first gray-scale parameter corresponding to pixel units in a first row and a second gray-scale parameter corresponding to pixel units in a second row; the timing controller pulls up a potential of the pre-charge signal when determining that the gray scale eigenvalue is less than a gray-scale threshold; when the pre-charge signal is at a high potential, the gate drive unit prolongs a duration of providing a scanning signal to a gate line in a first row, and provides a scanning signal to a gate line in a second row within a scanning period of providing the scanning signal to the gate line in the first row.

The technical problem of this application may be further resolved by taking the following technical measures.

In an embodiment of this application, the timing controller pulls down the potential of the pre-charge signal when determining that the gray-scale eigenvalue is greater than the gray-scale threshold; the gate drive unit provides the scanning signal to a gate line in a corresponding row within each scanning period when the pre-charge signal is at a low potential.

In an embodiment of this application, the first gray-scale parameter is an average value, a root mean square value, a maximum value, or a minimum value of all first gray-scale values corresponding to the pixel units in the first row; the second gray-scale parameter is an average value, a root mean square value, a maximum value, or a minimum value of all second gray-scale values corresponding to the pixel units in the second row In an embodiment of this application, the gray-scale eigenvalue is an absolute value of a difference between the first gray-scale parameter and the second gray-scale parameter.

In an embodiment of this application, the gray-scale threshold is stored in the timing controller; or the timing controller uses a half of a larger one of the first gray-scale parameter and the second gray-scale parameter as the gray-scale threshold.

Another objective of this application is a pre-charge switching method for pixel units of a display panel, comprising: obtaining, by a timing controller, a first gray-scale parameter corresponding to pixel units in a first row and a second gray-scale parameter corresponding to pixel units in a second row; calculating, by the timing controller, a gray-scale eigenvalue according to the first gray-scale parameter and the second gray-scale parameter; when determining, by the timing controller, that the gray-scale eigenvalue is less than a gray-scale threshold, pulling up a potential of a pre-charge signal; and providing, by a gate drive unit, a scanning signal to a gate line in a second row within a period of providing a scanning signal to a gate line in a first row when the pre-charge signal is at a high potential.

The technical problem of this application may be further resolved by taking the following technical measures.

In an embodiment of this application, the timing controller pulls down the potential of the pre-charge signal when determining that the gray-scale eigenvalue is greater than the gray-scale threshold; the gate drive unit provides the scanning signal to a gate line in a corresponding row within each scanning period when the pre-charge signal is at a low potential.

In an embodiment of this application, the gray-scale threshold is stored in the timing controller; or the timing controller uses a half of a larger one of the first gray-scale parameter and the second gray-scale parameter as the gray-scale threshold.

In an embodiment of this application, the timing controller obtains a first gray-scale maximum value according to all gray-scale values corresponding to the pixel units in the first row, the timing controller obtains a second gray-scale maximum value according to all gray-scale values corresponding to the pixel units in the second row, and the timing controller uses a half of a larger one of the first gray-scale maximum value and the second gray-scale maximum value as the gray-scale threshold.

Still another of this application is a display panel, comprising: a substrate, comprising a display area and a wiring area around the display area, where a plurality of active switches, a plurality of gate lines, and a plurality of source lines are disposed in the display area, and a pixel unit is disposed at an intersection of each gate line and each source line; a source drive unit, connected to the plurality of source lines; a gate drive unit, connected to the plurality of gate lines; a timing controller, connected to the source drive unit and the gate drive unit; and a pre-charge line, connected between the timing controller and the gate drive unit, where the pre-charge line transmits a pre-charge signal output by the timing controller; and the timing controller stores a gray-scale threshold; the gray-scale threshold is an average value or a median of gray-scale display bits of the display panel; during a same data frame, the timing controller calculates a first gray-scale average value according to all gray-scale values corresponding to pixel units in a first row; the timing controller calculates a second gray-scale average value according to all gray-scale values corresponding to pixel units in a second row; the timing controller calculates an absolute value of a difference between the first gray-scale average value and the second gray-scale average value and uses the absolute value as a gray-scale eigenvalue; the timing controller pulls up a potential of the pre-charge signal when the gray-scale eigenvalue is less than the gray-scale threshold; the timing controller pulls down the potential of the pre-charge signal when the gray-scale eigenvalue is greater than the gray-wale threshold; when the pre-charge signal is at a high potential, the gate drive unit prolongs a duration of providing a scanning signal to a gate line in a first row, and provides a scanning signal to a gate line in a second row within a scanning period of providing the scanning signal to the gate line in the first row; the gate drive unit provides the scanning signal to a gate line in a corresponding row within each scanning period when the pre-charge signal is at a low potential.

In this application, a pre-charge moment can be relatively effectively determined by using gray-scale parameters of pixel units in each two adjacent rows, so as to determine whether to conduct a behavior of pre-charging pixel units in a next row, and a situation of excessive pre-charging can be relatively prevented from occurring. A pre-charge mode is dynamically adjusted in this way to reduce operation power consumption of the display panel.

BRIEF DESCRIPTION OF THE DRAWINGS

FIG. 2*c* is a schematic diagram of a list of gray-scale parameters of pixel units according to an embodiment of a method of this application;

FIG. 2*d* is a schematic diagram of a list of gray-scale parameters of pixel units according to an embodiment of a method of this application;

FIG. 2*e* is a schematic diagram of a list of gray-scale parameters of pixel units according to an embodiment of a method of this application.

DETAILED DESCRIPTION

Figure 1A:
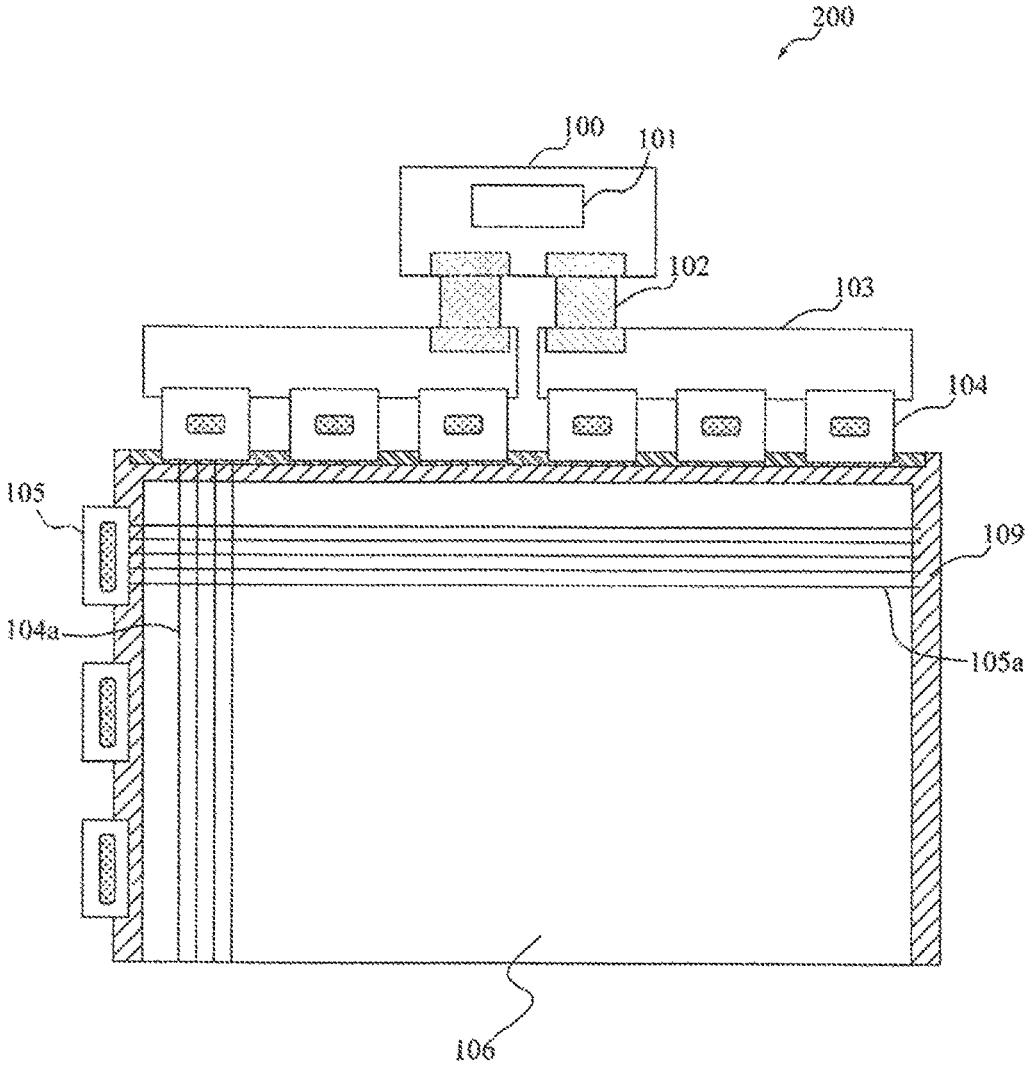
FIG. 1*a* is a schematic diagram of an architecture of an exemplary display device.

The following embodiments are described with reference to the accompanying drawings, used to exemplify specific embodiments for implementation of this application. Terms about directions mentioned in this application, such as "on", "below", "front", "back", "left", "right", "in", "out", and "side surface" merely refer to directions in the accompanying drawings. Therefore, the used terms about directions are used to describe and understand this application, and are not intended to limit this application.

The accompanying drawings and the description are considered to be essentially exemplary, rather than limitative. In the figures, modules with similar structures are represented by using the same reference number. In addition, for understanding and ease of description, the size and the thickness of each component shown in the accompanying drawings are arbitrarily shown, but this application is not limited thereto.

In the accompanying drawings, for clarity, thicknesses of a layer, a film, a panel, an area, and the like are enlarged, and a configuration range of a circuit is also enlarged. In the accompanying drawings, for understanding and ease of description, thicknesses of some layers and areas are enlarged, and a configuration range of a circuit is also enlarged. It should be understood that when a component such as a layer, a film, an area, a circuit, or a base is described to he "on" "another component", the component may be directly on the another component, or there may be an intermediate component.

In addition, throughout this specification, unless otherwise explicitly described to have an opposite meaning, the word "include" is understood as including the component, but not excluding any other component. In addition, throughout this specification, "on" means that one is located above or below a target component and does not necessarily mean that one is located on the top based on a gravity direction.

To further describe the technical means used in this application to achieve the application objective and effects thereof, specific implementations, structures, features, and effects of a display panel and a pre-charge switching method for pixel units thereof provided according to this application are described in detail below with reference to the drawings and preferred embodiments.

In some embodiments, the display panel of this application may be, for example, a liquid crystal display panel, but is not limited thereto. Alternatively, the display panel may be an OLEIC display panel, a W-OLED display panel, a QLED display panel, a plasma display panel, a curved display panel, or display panels of other types.

The display panel of this application may include an active array (thin film transistor, TFT) substrate and a color filter (CF) substrate. When the display panel of this application is a liquid crystal display panel, a liquid crystal layer is disposed between the active array substrate and the CF substrate.

In an embodiment, an active array switch (TFT) and a CF of this application are formed on a same substrate.

FIG. 1*a* is a schematic diagram of an architecture of an exemplary display device. Referring to FIG. 1*a,* the display device includes: a control board 100, including a timing controller (Timing Controller, TCON) 101; and a printed circuit board 103, connected to the control board by using a flexible flat cable (FFC) 102, where a source driver 104 and a gate driver 105 are respectively connected to a data line and a scanning line in a display area 106. In some embodiments, the gate driver 105 and the source driver 104 include, but are not limited to, a chip-on-film form.

In some embodiments, a display may be of a gate-on-array type. The gate driver 105 may be divided into a level shifter and a shift register. The level shifter is disposed on the control board, and the shift register is disposed on an active array substrate.

In some embodiments, a drive manner of the display device includes: a system board transmits a color (such as R/G/B) compressed signal, a control signal, and a power source to the control board 100. After being processed by the timing controller 101 on the control board 100, the signals, together with the power source processed by the drivers, are transmitted to the source driver 104 and the gate driver 105 of the printed circuit hoard 103 by using, for example, the FFC 102. The source driver 104 and the gate driver 105 transmit necessary data and a power source to the display area 106 by using a gate line 105*a* and a source line 104*a,* so that a display obtains a power source and signals required for picture presentation. The gate line 105*a* and the source line 104*a* shown in FIG. 1*a* are only schematic, and a wiring manner is limited thereto.

Figure 1B:
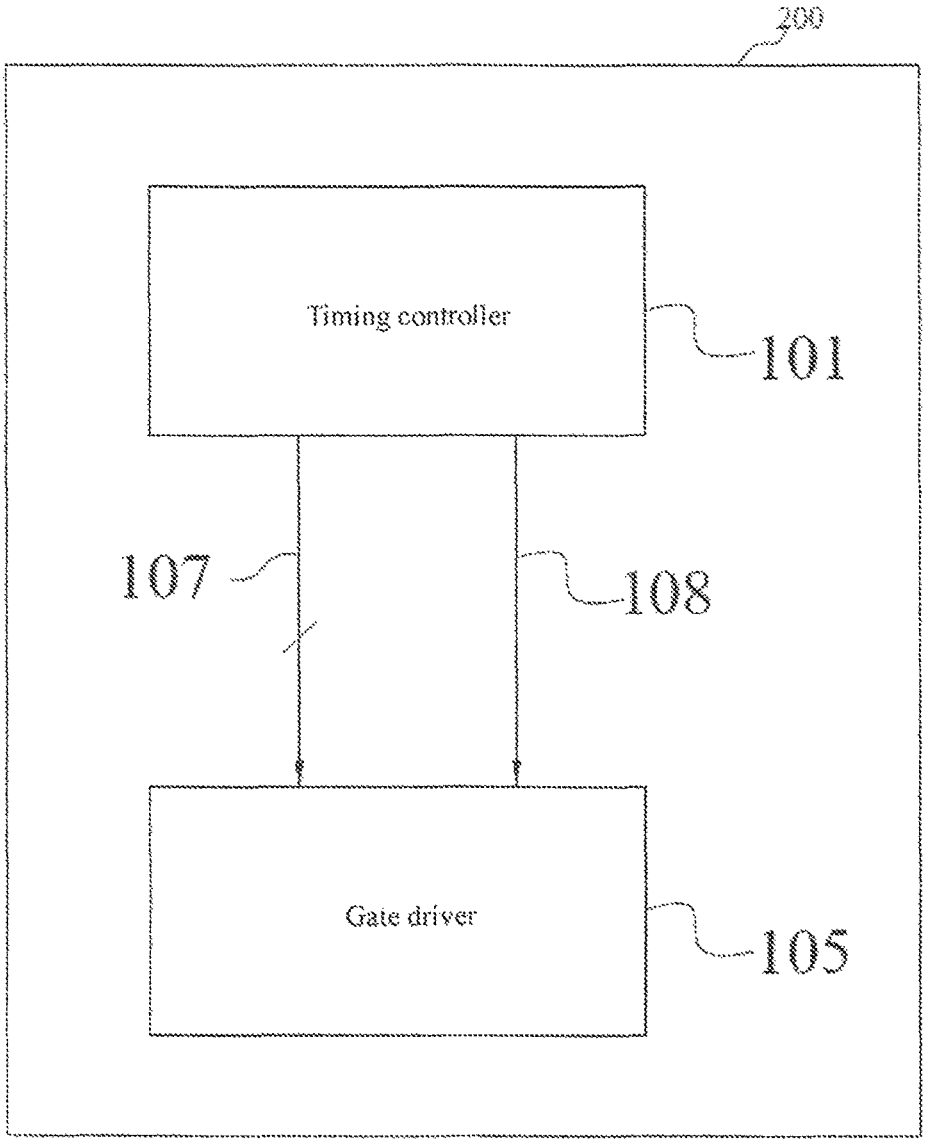
FIG. 1*b* is a schematic diagram of configuration of a pre-charge line of an exemplary display panel.
Figure 1C:
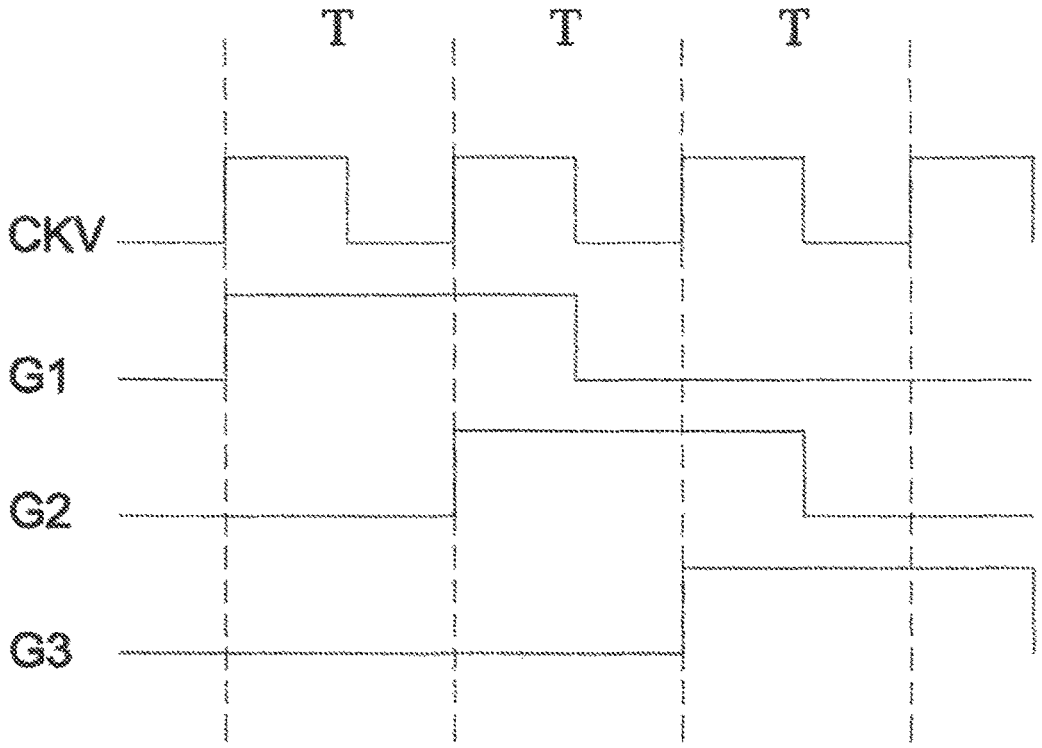
FIG. 1*c* is a schematic diagram of a pre-charge signal of an exemplary display panel.
Figure 1D:
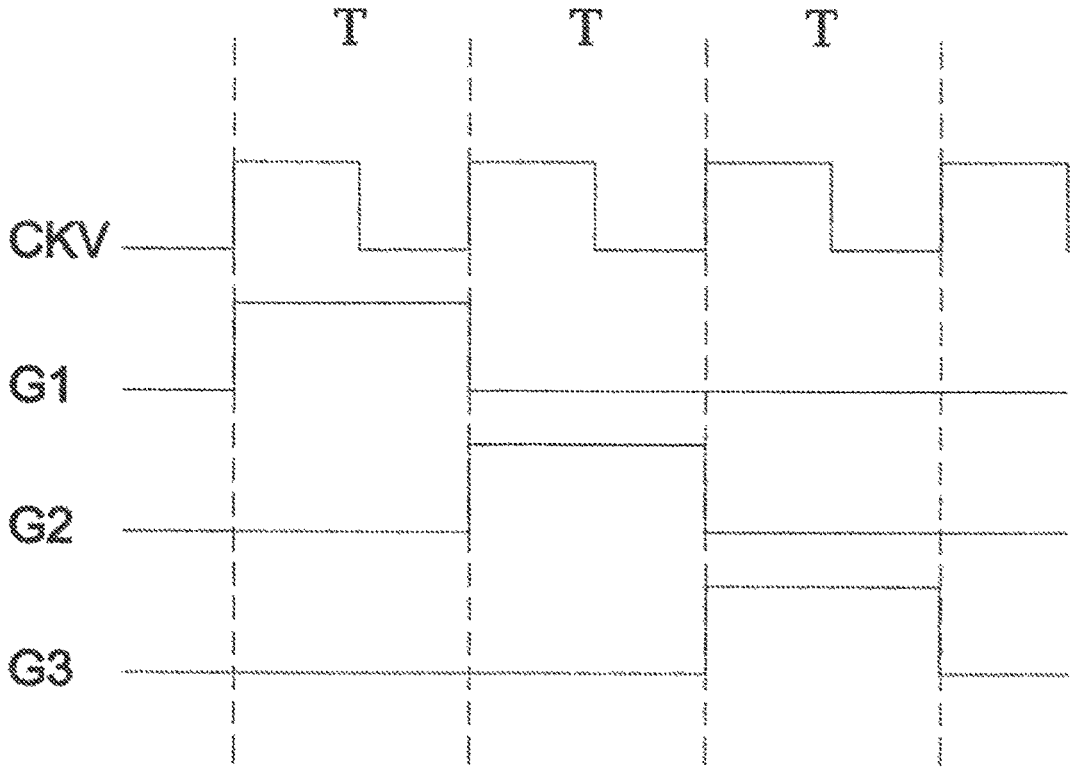
FIG. 1*d* is a schematic diagram of a normal scanning signal of an exemplary display panel.

FIG. 1*b* is a schematic diagram of configuration of a pre-charge line of an exemplary display panel; FIG. 1*c* is a schematic diagram of a pre-charge signal of an exemplary display panel; FIG. 1*d* is a schematic diagram of a normal scanning signal of an exemplary display panel. For ease of understanding, refer to FIG. 1*a*. In some embodiments, besides a control line 107, a pre-charge line 108 is disposed between the timing controller 101 and the gate driver 105. A potential of the pre-charge line 108 is controlled by the timing controller 101. When the pre-charge line 108 is set to be at a high potential, the gate driver 105 pre-charges pixel units in a G2$^{th}$ row according to a design within a period of charging pixel units in a G1$^{th}$ row. When the pre-charge line 108 is at a low potential (L), the gate driver 105 enables only a gate line corresponding to a current scanning period. Generally, the pre-charge line 108 is normally set to be at a high potential (H) or a low potential (L). However, the pre-charge line 108 is normally kept at a low potential (L), and the display panel does not perform pre-charging, that is, power consumption cannot be reduced by means of pre-charging. If the pre-charge line 108 is normally kept at a high potential (H), and a difference between gray-scale values of pixel units in two adjacent rows is excessively large, a pre-charge time is excessively long. As a result, power consumption increases, and power consumption cannot be reduced by means of pre-charging.

Figure 2A:
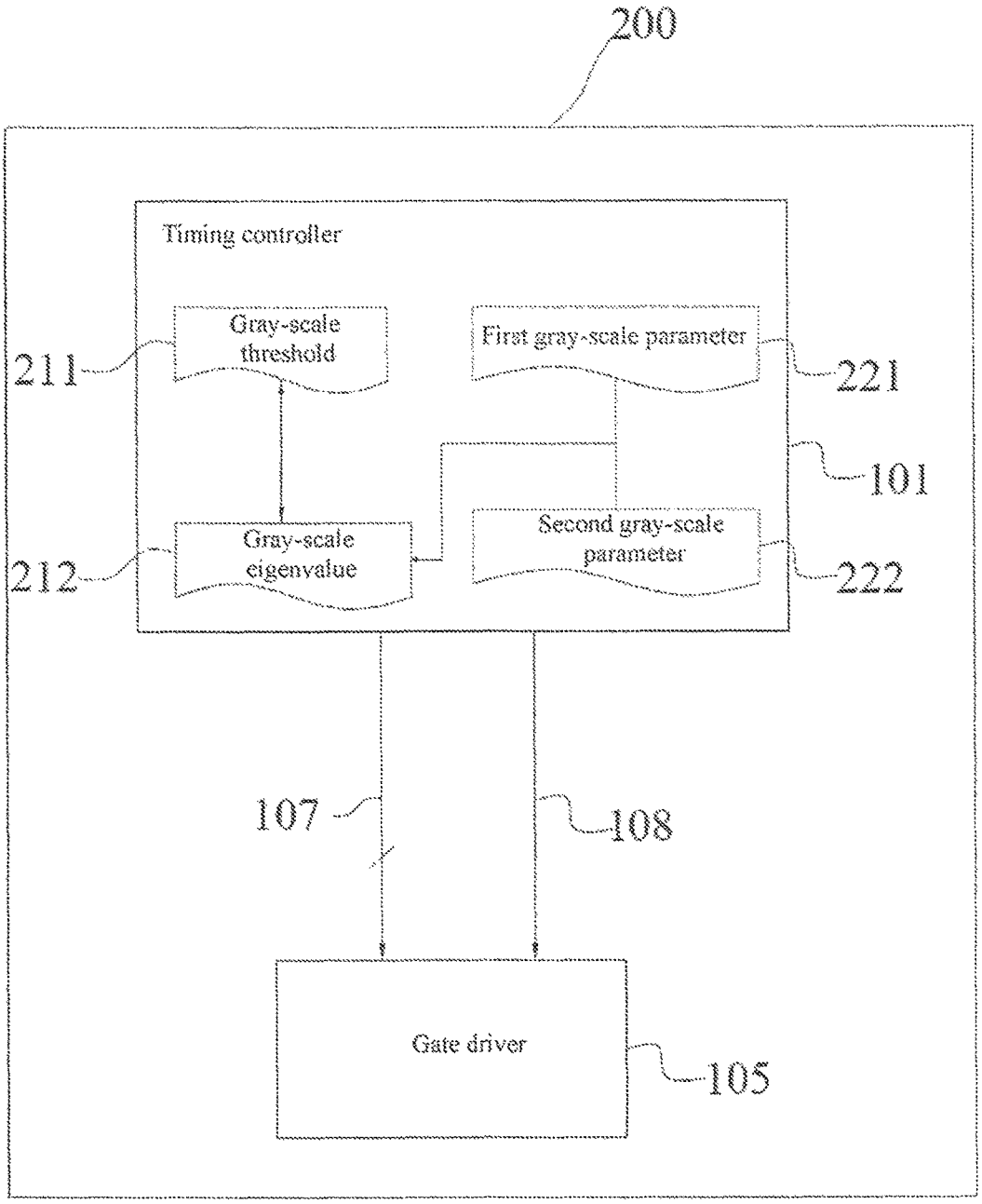
FIG. 2*a* is a schematic diagram of an architecture of a timing controller according to an embodiment of a method of this application.
Figure 2B:
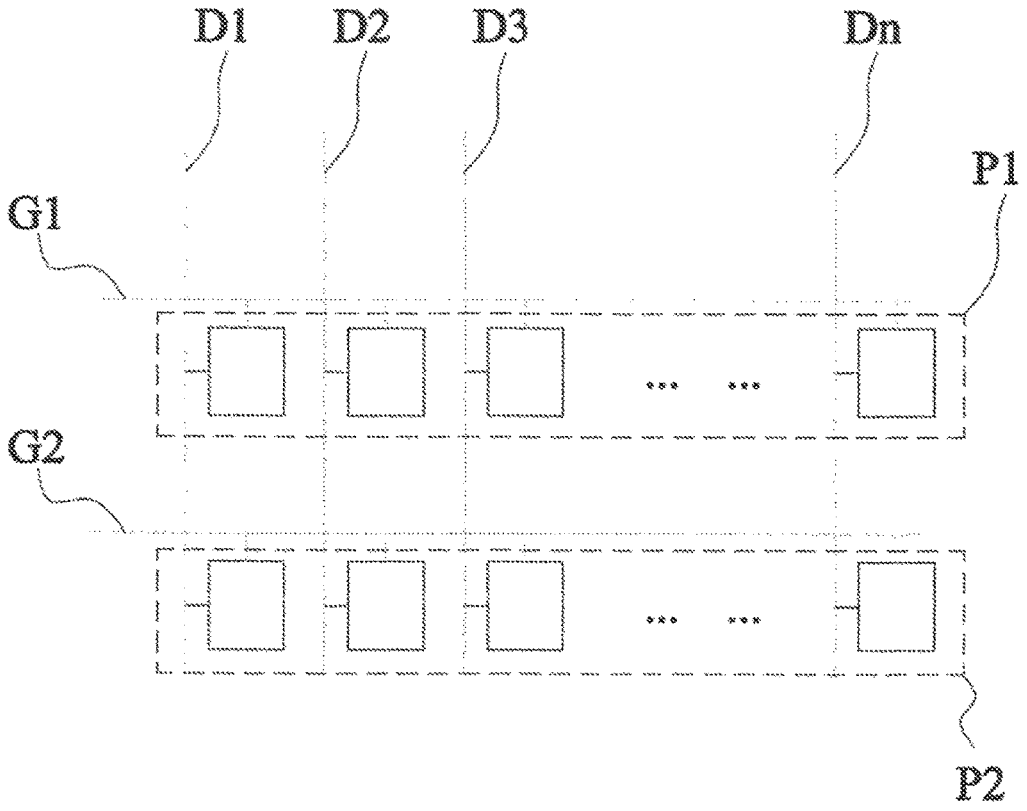
FIG. 2*b* is a schematic diagram of configuration of pixel units according to an embodiment of a method of this application.

FIG. 2*a* is a schematic diagram of an architecture of a timing controller of a display panel according to an embodiment of a method of this application. FIG. 2*b* is a schematic diagram of configuration of pixel units according to an embodiment of a method of this application. For ease of understanding, refer to FIG. 1*a* to FIG. 1*d* for configuration of components of an existing display panel. Referring to FIG. 2*a*, in an embodiment of this application, a substrate includes a display area 106 and a wiring area 109 around the display area 106, where a plurality of active switches, a plurality of gate lines 105*a,* and a plurality of source lines 104*a* are disposed in the display area 106, and a pixel unit is disposed at an intersection of each gate line 105*a* and each source line 104*a*. A source drive unit 104 is connected to the plurality of source lines 104*a*. A gate drive unit 105 is connected to the plurality of gate lines 105*a*. A timing controller 101 is connected to the source drive unit 104 and the gate drive unit 105. A pre-charge line 108 is connected between the timing controller 101 and the gate drive unit 105. The pre-charge line 108 transmits a pre-charge signal output by the timing controller 101. The timing controller 101 calculates a gray-scale eigenvalue 212 by using a first gray-scale parameter 221 corresponding to pixel units P1 in a first row and a second gray-scale parameter 222 corresponding to pixel units P2 in a second row. The timing controller 101 pulls up a potential of the pre-charge signal when determining that the gray-scale eigenvalue 212 is less than a gray-scale threshold 211. When the pre-charge signal is at a high potential, the gate drive unit 105 prolongs a duration of providing a scanning signal to a gate line G1 in a first row, and provides a scanning signal to a gate line G2 in a second row within a scanning period of providing the scanning signal to the gate line G1 in the first row.

In some embodiments, the timing controller 101 pulls down the potential of the pre-charge signal when determining that the gray-scale eigenvalue 212 is greater than the gray-scale threshold 211; the gate drive unit 105 provides the scanning signal to a gate line 105*a* in a corresponding row within each scanning period when the pre-charge signal is at a low potential.

FIG. 2*c* is a schematic diagram of a list of gray-scale parameters of pixel units according to an embodiment of a method of this application. In some embodiments, the timing controller 101 stores gray-scale values corresponding to all pixel units of a same data frame. FIG. 2*c* shows an example of gray-scale values corresponding to pixel units in two adjacent rows but is not limited thereto. The pixel units in the two rows are respectively pixel units P1 in a first row and pixel units P2 in a second row In some embodiments, the first gray-scale parameter 221 is an average value, a root mean square value, a maximum value, or a minimum value of all first gray-scale values corresponding to the pixel units P1 in the first row; the second gray-scale parameter 222 is an average value, a root mean square value, a maximum value, or a minimum value of all second gray-scale values corresponding to the pixel units P2 in the second row The description herein uses an average value as an example but is not limited thereto.

In some embodiments, the gray-scale eigenvalue 212 is an absolute value of a difference between the first gray-scale parameter 221 and the second gray-scale parameter 222.

In some embodiments, the gray-scale threshold 211 may be determined according to requirements of a designer or may be set to an average value or a median of gray-scale display bits of the display panel. For example, the gray-scale threshold 211 corresponding to eight-bit gray-scale display is $2^8/2=128$, and the gray-scale threshold 211 corresponding to 10-bit gray-scale display is $2^{10}/2=512$.

As shown in FIG. 2*c*, in some embodiments, using eight-bit gray-scale display for description, the first gray-scale parameter 221 is an average value of all first gray-scale values and has a value of 218. The second gray-scale parameter 222 is an average value of all second gray-scale values and has a value of 23. The gray-scale eigenvalue 212 is |218−23|=195, and 195>128, that is, the gray-scale eigenvalue 212 is greater than the gray-scale threshold 211. The timing controller does not pull up a potential of the pre-charge signal.

FIG. 2*d* is a schematic diagram of a list of gray-scale parameters of pixel units according to an embodiment of a method of this application. In some embodiments, as shown in FIG. 2*d*, in some embodiments, using eight-bit gray-scale display for description, the first gray-scale parameter 221 is an average value of all first gray-scale values and has a value of 218. The second gray-scale parameter 222 is an average value of all second gray-scale values and has a value of 214. The gray-scale eigenvalue 212 is |218−214|=4, and 4<128, that is, the gray-scale eigenvalue 212 is less than the gray-scale threshold 211. The timing controller 101 pulls up a potential of the pre-charge signal.

FIG. 2*e* is a schematic diagram of a list of gray-scale parameters of pixel units according to an embodiment of a method of this application. In some embodiments, using eight-bit gray-scale display for description, the timing controller 101 calculates a gray-scale difference between two adjacent pixels among the pixel units P1 in the first row and the pixel units P2 in the second row, and performs accumulation when the gray-scale difference is greater than the gray-scale threshold 211. Accumulation starts from 0, and the gray-scale difference is the gray-scale eigenvalue 212. A preset threshold is additionally designed and is a median of a total quantity of columns of pixel units. Assuming that the total quantity of columns is 12, the median of the preset threshold, that is, 12, is 6. As shown in FIG. 2*e*, a gray-scale difference of pixel units D1 in a first column is 13, and the timing controller 101 adds 1 to an accumulated value. A gray-scale difference of pixel units D2 in a second column is 184, and the timing controller 101 does not perform accumulation. The rest can be deduced by analogy. It is learned through calculation that a quantity of times of accumulation is 7, and 7 is greater than the preset threshold. Therefore, the timing controller 101 pulls up the potential of the pre-charge signal. Correspondingly, if a quantity of times of accumulation is less than 6, the timing controller 101 pulls down the potential of the pre-charge signal.

In some embodiments, the gray-scale threshold 211 is stored in the timing controller 101.

In some embodiments, the tinting controller 101 separately obtains an average value of all first gray-scale values and an average value of all second gray-scale values, and uses a half of a larger one of the two average values as the gray-scale threshold 211.

In some embodiments, the timing controller 101 separately obtains a maximum value of all first gray-scale values and a maximum value of all second gray-scale values, and uses a half of a larger one of the two maximum values as the gray-scale threshold 211.

As shown in FIG. 2*c*, in some embodiments, the first gray-scale parameter 221 is a first gray-scale average value of all first gray-scale values and has a value of 218. The second gray-scale parameter 222 is a second gray-scale average value of all second gray-scale values and has a value of 23. The gray-scale eigenvalue 212 is |218−23|=195. The gray-scale threshold 211 is a half of a larger one of the two average values, that is, 218/2=109. 195>109, that is, the gray-scale eigenvalue 195 is greater than the gray-scale threshold 109. The timing controller does not pull up the potential of the pre-charge signal.

As shown in FIG. 2*d*, in some embodiments, the first gray-scale parameter 221 is a first gray-scale maximum value of all first gray-scale values and has a value of 255. The second gray-scale parameter 222 is a second gray-scale maximum value of all second gray-scale values and has a value of 251. The gray-scale eigenvalue 212 is |218−214|=4, and the gray-scale threshold 211 is a half of a larger one of the two maximum values, that is, 255/2=128 (rounding). 4<128, that is, the gray-scale eigenvalue 212 is less than the gray-scale threshold 211. The timing controller 101 pulls up the potential of the pre-charge signal.

FIG. 2*e* is a schematic diagram of a list of gray-scale parameters of pixel units according to an embodiment of a method of this application. In some embodiments, the first gray-scale parameter 221 is a first gray-scale average value of all first gray-scale values and has a value of 117. The second gray-scale parameter 222 is a second gray-scale average value of all second gray-scale values and has a value of 207. The gray-scale eigenvalue 212 is |117−207|=45. The gray-scale threshold 211 is a half of a largest one of all the first gray-scale values and all the second gray-scale values, that is, 253/2−127 (rounding). 45<127, that is, the gray-scale eigenvalue 212 is less than the gray-scale threshold 211. The timing controller 101 pulls up the potential of the pre-charge signal.

Figure 3:
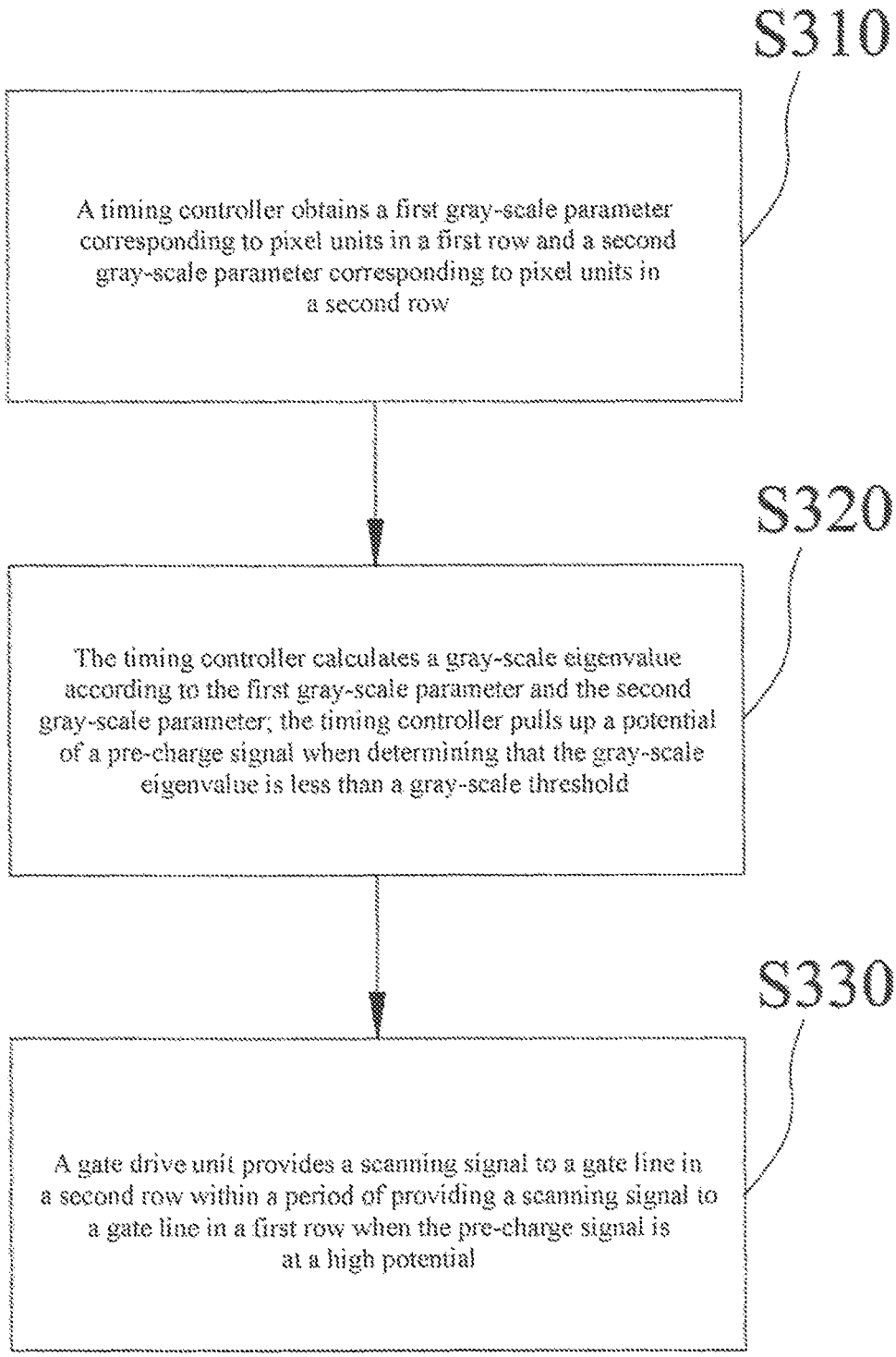
FIG. 3 is a schematic flowchart of a pre-charge switching method for pixel units according to an embodiment of a method of this application.

FIG. 3 is a schematic flowchart of a pre-charge switching method for pixel units according to an embodiment of a method of this application. For ease of understanding, refer to FIG. 1*a* to FIG. 2*e*. The method includes:

Step S310: A timing controller 101 obtains a first gray-scale parameter 221 corresponding to pixel units P1 in a first row and a second gray-scale parameter 222 corresponding to pixel units P2 in a second row.

Step S320: The timing controller 101 calculates a gray-scale eigenvalue 212 according to the first gray-scale parameter 221 and the second gray-scale parameter 222; the timing controller 101 pulls up a potential of a pre-charge signal when determining that the gray-scale eigenvalue 212 satisfies a condition of being less than a gray-scale threshold 211.

In some embodiments, the timing controller 101 pulls down the potential of the pre-charge signal when determining that the gray-scale eigenvalue 212 is greater than the gray-scale threshold 211; the gate drive unit 105 provides a scanning signal to a gate line in a corresponding row within each scanning period when the pre-charge signal is at a low potential.

In some embodiments, the gray-scale threshold is stored in the timing controller; or the timing controller uses a half of a larger one of the first gray-scale parameter and the second gray-scale parameter as the gray-scale threshold. The timing controller obtains a first gray-scale maximum value according to all gray-scale values corresponding to the pixel units in the first row, the timing controller obtains a second gray-scale maximum value according to all gray-scale values corresponding to the pixel units in the second row, and the timing controller uses a half of a larger one of the first gray-scale maximum value and the second gray-scale maximum value as the gray-scale threshold.

In some embodiments, the timing controller 101 calculates a gray-scale difference between two adjacent pixels among the pixel units P1 in the first row and the pixel units P2 in the second row, performs accumulation when the gray-scale difference is greater than the gray-scale threshold 211, and determines, when an accumulated value is greater than a preset threshold, that the gray-scale eigenvalue 212 satisfies a condition of the gray-scale threshold 211, to pull up the potential of the pre-charge signal.

Step S330: A gate drive unit 105 provides a scanning signal to a gate line G2 in a second row within a period of providing a scanning signal to a gate line G1 in a first row when the pre-charge signal is at a high potential.

In an embodiment of this application, a display panel 200 of this application includes: a substrate, including a display area 106 and a wiring area 109 around the display area, where a plurality of gate lines 105*a* and a plurality of source lines 104*a* are disposed in the display area 106, and a pixel unit is disposed at an intersection of each gate line 105*a* and each source line 104*a;* a source drive unit 104, connected to the plurality of source lines 104*a;* a gate drive unit 105, connected to the plurality of gate lines 105*a;* a timing controller 101, connected to the source drive unit 104 and the gate drive unit 105; and a pre-charge line 108, connected between the timing controller 101 and the gate drive unit 105, where the pre-charge line 108 transmits a pre-charge signal output by the timing controller 101; and the timing controller 101 stores a gray-scale threshold 211; the gray-scale threshold 211 is an average value or a median of gray-scale display bits of the display panel; during a same data frame, the timing controller 101 calculates a first gray-scale average value according to all gray-scale values corresponding to pixel units P1 in a first row; the timing controller 101 calculates a second gray-scale average value according to all gray-scale values corresponding to pixel units P2 in a second row; the timing controller 101 calculates an absolute value of a difference between the first gray-scale average value and the second gray-scale average value and uses the absolute value as a gray-scale eigenvalue 212; the timing controller 101 pulls up a potential of the pre-charge signal when the gray-scale eigenvalue 212 is less than the gray-scale threshold 211; the timing controller 101 pulls down the potential of the pre-charge signal when the gray-scale eigenvalue 212 is greater than the gray-scale threshold 211; when the pre-charge signal is at a high potential, the gate drive unit 105 prolongs a duration of providing a scanning signal to a gate line G1 in a first row, and provides a scanning signal to a gate line G2 in a second row within a scanning period of providing the scanning signal to the gate line G1 in the first row; the gate drive unit 105 provides the scanning signal to a gate line 105*a* in a corresponding row within each scanning period when the pre-charge signal is at a low potential.

In this application, a pre-charge moment can be relatively effectively determined by using gray-scale parameters of pixel units in each two adjacent rows, so as to determine whether to conduct a behavior of pre-charging pixel units in a next row, and a situation of excessive pre-charging can be relatively prevented from occurring. A pre-charge mode is dynamically adjusted in this way to reduce operation power consumption of the display panel. Secondly, this application can be applied to display panels of many types and has relatively high applicability.

The wordings such as "in some embodiments" and "in various embodiments" are repeatedly used. They usually do not refer to a same embodiment; but they may refer to a same embodiment. The words, such as "comprise", "have", and "include", are synonyms, unless other meanings are indicated in the context thereof.

The foregoing descriptions are merely specific embodiments of this application, and are not intended to limit this application in any form. Although this application has been disclosed above through the specific embodiments, the embodiments are not intended to limit this application. Any person skilled in the art can make some Variations or modifications, namely, equivalent changes, according to the foregoing disclosed technical content to obtain equivalent embodiments without departing from the scope of the technical solutions of this application. Any simple amendment, equivalent change, or modification made to the foregoing embodiments according to the technical essence of this application without departing from the content of the technical solutions of this application shall fall within the scope of the technical solutions of this application.

What is claimed is:

1. A display panel, comprising:

a substrate, comprising a display area and a wiring area around the display area, wherein a plurality of active switches, a plurality of gate lines, and a plurality of source lines are disposed in the display area, and a pixel unit is disposed at an intersection of each gate line and each source line;

a source drive unit, connected to the plurality of source lines;

a gate drive unit, connected to the plurality of gate lines;

a timing controller, connected to the source drive unit and the gate drive unit; and a pre-charge line, connected between the timing controller and the gate drive unit, wherein the pre-charge line transmits a pre-charge signal output by the timing controller; and the timing controller calculates a gray-scale eigenvalue by using a first gray-scale parameter corresponding to pixel units in a first row and a second gray-scale parameter corresponding to pixel units in a second row; the timing controller pulls up a potential of the pre-charge signal when determining that the gray-scale eigenvalue is less than a gray-scale threshold; when the pre-charge signal is at a high potential, the gate drive unit prolongs a duration of providing a scanning signal to a gate line in a first row, and provides a scanning signal to a gate line in a second row within a scanning period of providing the scanning signal to the gate line in the first row.

2. The display panel according to claim 1, wherein the timing controller pulls down the potential of the pre-charge signal when determining that the gray-scale eigenvalue is greater than the gray-scale threshold.

3. The display panel according to claim 2, wherein the gate drive unit provides the scanning signal to a gate line in a corresponding row within each scanning period when the pre-charge signal is at a low potential.

4. The display panel according to claim 1, wherein the first gray-scale parameter is an average value of all first gray-scale values corresponding to the pixel units in the first row.

5. The display panel according to claim 1, wherein the first gray-scale parameter is a root mean square value of all first gray-scale values corresponding to the pixel units in the first row.

6. The display panel according to claim 1, wherein the first gray-scale parameter is a maximum value of all first gray-scale values corresponding to the pixel units in the first row.

7. The display panel according to claim 1, wherein the first gray-scale parameter is a minimum value of all first gray-scale values corresponding to the pixel units in the first row.

8. The display panel according to claim 1, wherein the second gray-scale parameter is an average value of all second gray-scale values corresponding to the pixel units in the second row.

9. The display panel according to claim 1, wherein the second gray-scale parameter is a root mean square value of all second gray-scale values corresponding to the pixel units in the second row.

10. The display panel according to claim 1, wherein the second gray-scale parameter is a maximum value of all second gray-scale values corresponding to the pixel units in the second row.

11. The display panel according to claim 1, wherein the second gray-scale parameter is a minimum value of all second gray-scale values corresponding to the pixel units in the second row.

12. The display panel according to claim 1, wherein the gray-scale eigenvalue is an absolute value of a difference between the first gray-scale parameter and the second gray-scale parameter.

13. The display panel according to claim 1, wherein the gray-scale threshold is stored in the timing controller.

14. The display panel according to claim 1, wherein the timing controller uses a half of a larger one of the first gray-scale parameter and the second gray-scale parameter as the gray-scale threshold.

15. A pre-charge switching method for pixel units of a display panel, comprising:

obtaining, by a timing controller, a first gray-scale parameter corresponding to pixel units in a first row and a second gray-scale parameter corresponding to pixel units in a second row;

calculating, by the timing controller, a gray-scale eigenvalue according to the first gray-scale parameter and the second gray-scale parameter;

when determining, by the timing controller, that the gray-scale eigenvalue is less than a gray-scale threshold, pulling up a potential of a pre-charge signal; and providing, by a gate drive unit, a scanning signal to a gate line in a second row within a period of providing a scanning signal to a gate line in a first row when the pre-charge signal is at a high potential.

16. The pre-charge switching method for pixel units of a display panel according to claim 15, further comprising:

pulling down the potential of the pre-charge signal when the timing controller determines that the gray-scale eigenvalue is greater than the gray-scale threshold; and providing, by the gate drive unit, the scanning signal to a gate line in a corresponding row within each scanning period when the pre-charge signal is at a low potential.

17. The pre-charge switching method for pixel units of a display panel according to claim 15, wherein the gray-scale threshold is stored in the timing controller.

18. The pre-charge switching method for pixel units of a display panel according to claim 15, wherein the timing controller uses a half of a larger one of the first gray-scale parameter and the second gray-scale parameter as the gray-scale threshold.

19. The pre-charge switching method for pixel units of a display panel according to claim 15, wherein the timing controller obtains a first gray-scale maximum value according to all gray-scale values corresponding to the pixel units in the first row, the timing controller obtains a second gray-scale maximum value according to all gray-scale values corresponding to the pixel units in the second row, and the timing controller uses a half of a larger one of the first gray-scale maximum value and the second gray-scale maximum value as the gray-scale threshold.

20. A display panel, comprising:

a substrate, comprising a display area and a wiring area around the display area, wherein a plurality of active switches, a plurality of gate lines, and a plurality of source lines are disposed in the display area, and a pixel unit is disposed at an intersection of each gate line and each source line;

a source drive unit, connected to the plurality of source lines;

a gate drive unit, connected to the plurality of gate lines;

a timing controller, connected to the source drive unit and the gate drive unit; and a pre-charge line, connected between the timing controller and the gate drive unit, wherein the pre-charge line transmits a pre-charge signal output by the timing controller; and the timing controller stores a gray-scale threshold; the gray-scale threshold is an average value or a median of gray-scale display bits of the display panel; during a same data frame, the timing controller calculates a first gray-scale average value according to all gray-scale values corresponding to pixel units in a first row; the timing controller calculates a second gray-scale average value according to all gray-scale values corresponding to pixel units in a second row; the timing controller calculates an absolute value of a difference between the first gray-scale average value and the second gray-scale average value and uses the absolute value as a gray-scale eigenvalue; the timing controller pulls up a potential of the pre-charge signal when the gray-scale eigenvalue is less than the gray-scale threshold; the timing controller pulls down the potential of the pre-charge signal when the gray-scale eigenvalue is greater than the gray-scale threshold; when the pre-charge signal is at a high potential, the gate drive unit prolongs a duration of providing a scanning signal to a gate line in a first row, and provides a scanning signal to a gate line in a second row within a scanning period of providing the scanning signal to the gate line in the first row; the gate drive unit provides the scanning signal to a gate line in a corresponding row within each scanning period when the pre-charge signal is at a low potential.

* * * * *